United States Patent [19]

Nandlal et al.

[11] Patent Number: 4,484,839

[45] Date of Patent: Nov. 27, 1984

[54] METHOD AND APPARATUS FOR INSTALLING ANODES ON STEEL PLATFORMS AT OFFSHORE LOCATIONS

[75] Inventors: Samlal Nandlal, Slidell; David P. McGuire, Gretna, both of La.

[73] Assignee: Shell Offshore Inc., Houston, Tex.

[21] Appl. No.: 536,793

[22] Filed: Sep. 28, 1983

[51] Int. Cl.[3] ..... E02B 17/00; C23F 13/00

[52] U.S. Cl. ..... 405/211; 405/195; 405/216; 204/147; 204/197

[58] Field of Search ..... 405/211, 216, 195, 203–208, 405/224–227; 204/197, 196, 147; 114/222

[56] References Cited

U.S. PATENT DOCUMENTS

| | | | |
|---|---|---|---|
| 2,571,062 | 10/1951 | Robinson et al. | 204/197 |
| 2,870,079 | 1/1959 | McCall | 204/197 |
| 4,056,446 | 11/1977 | Vennett | 204/197 |
| 4,089,767 | 5/1978 | Sabins | 204/197 |
| 4,211,503 | 7/1980 | Peterson et al. | 405/216 |
| 4,285,615 | 8/1981 | Radd | 405/211 |
| 4,292,149 | 9/1981 | Warne | 204/147 |
| 4,415,293 | 11/1983 | Engel et al. | 405/211 X |

*Primary Examiner*—Dennis L. Taylor

[57] ABSTRACT

A method and apparatus is provided for supplementing the substructure of an offshore platform within, or in the vicinity of, the well conductors of the platform so as to add large numbers of anodes distributed vertically within the platform adjacent the well conductors. A long anode carrier apparatus is run down through the platform substructure at one or more locations to support large numbers of anodes.

19 Claims, 10 Drawing Figures

FIG. 6
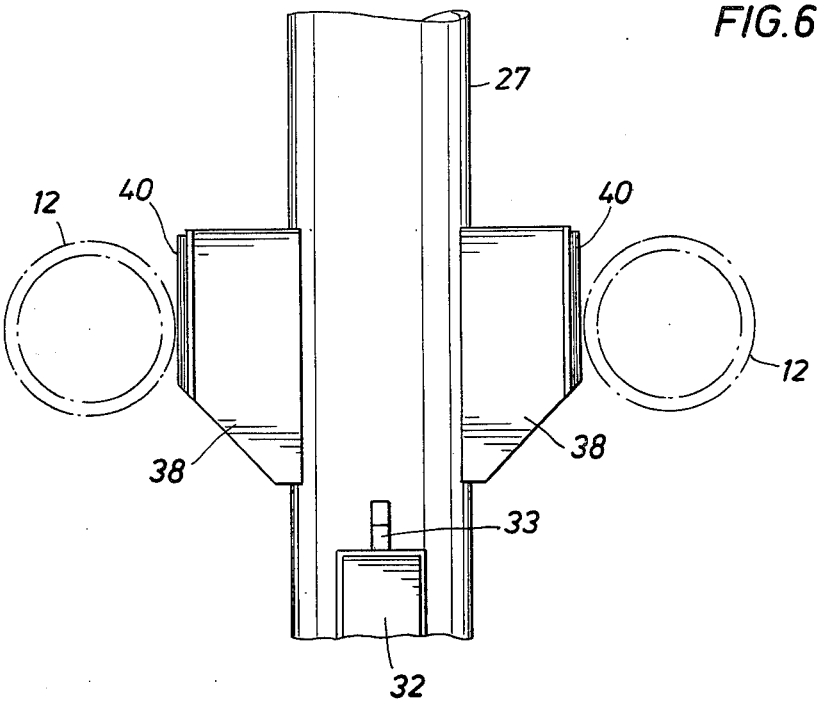
FIG. 7
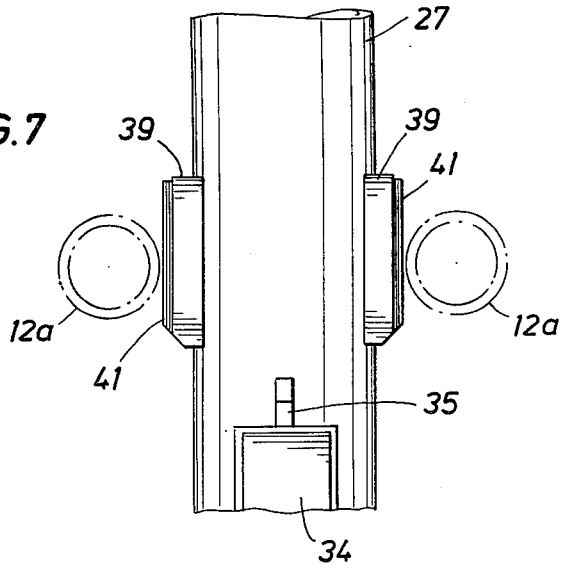
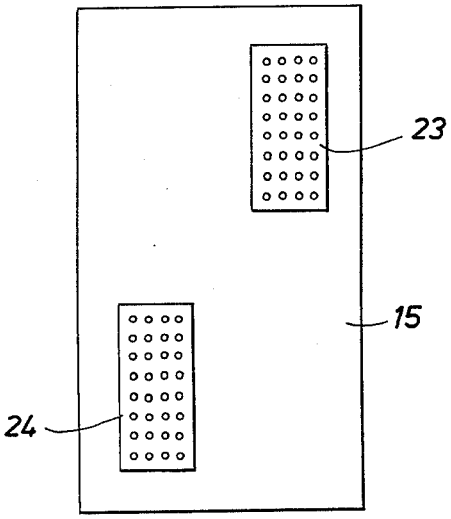
FIG. 10

METHOD AND APPARATUS FOR INSTALLING ANODES ON STEEL PLATFORMS AT OFFSHORE LOCATIONS

BACKGROUND OF THE INVENTION

This invention relates to a method and apparatus for providing additional or replacement anodes to prevent corrosion of a steel platform positioned at an offshore location.

Present day offshore platforms used in the oil and gas industry are often formed of large-diameter pipe elements in the form of three or more vertical or slanting legs interconnected or reinforced by cross-bracing tubular members. Such bottom-supported platforms have been used in waters up to 1025 feet deep. The deepwater platforms may have more legs which may be tapered. For example, one deepwater platform off the California coast has eight legs that are made of 72 inch diameter pipe at the ocean floor and taper upwardly to 48 inch diameter pipe at sea level. Cross-bracing members are mostly 36 or 42 inches in diameter. In addition, the platform is provided with sixty 24 inch diameter vertical pipes, risers or well conductors which are grouped near the center of the platform and through which individual wells are drilled. Further, the platform supports vertical pipe risers through which oil and gas may be separately pumped down to an ocean floor pipeline and thence to shore.

In order to protect the present offshore platforms from corrosion in sea water, the structural members of the platform are provided with a cathodic protection system which comprises fixedly securing to a plurality of the structural members a number of sacrificial anodes which are preferably made of aluminum, zinc, or an alloy of these and/or other metals, in a manner well known to the art. Anodes are often used which are made of magnesium which gives out a larger current than aluminum alloy anodes, although having a shorter life, as disclosed in U.S. Pat. No. 2,571,062. In addition to anodes being fixedly mounted on a platform, they may be suspended therefrom by chains or cables as shown in U.S. Pat. Nos. 2,870,079; 4,089,767; 4,292,149; and 4,056,446.

Corrosion in sea water is an electrochemical process. During the chemical reaction of metals with the environment to form corrosion products (such as rust on steel), metallic atoms give up one or more electrons to become positively charged ions, and oxygen and water combine with the electrons to form negatively charged ions. The reactions occur at rates which result in no charge build-up. All the electrons given up by metal atoms must be consumed by another reaction.

The cathodic protection of offshore platforms and other structures exposed to marine environments is an art which has been practiced for many years. The objective of all anode systems is to provide current flow from anodes to a platform so as to elevate the polarization level of the platform within the "protected" range; that is, the level at which electron emission from the protected platform to the surrounding sea water is substantially inhibited, thereby suppressing corrosion of the platform.

Cathodic protection is a process which prevents the anodic corrosion reaction by creating an electric field at the surface of the metal so that current flows into the metal. This prevents the formation of metal ions by setting up a potential gradient at the surface which opposes the electric current which arises from the flow of electrically charged ions away from the surface as the product of corrosion. The electric field must be of adequate strength to ensure that metal ions are fully prevented from escaping.

A source of the electric field which opposes the corrosion reaction may be a current supplied from the preferential corrosion of a metal anode with different electrochemical properties in the environment, and which has a stronger anodic reaction with the environment than does the offshore structure. Thus, current flows to the structure from the additional anode, which itself progressively corrodes in preference to the structures. This technique is known as sacrificial anode cathodic protection. This method is used extensively for the protection of offshore platforms, drilling rigs, submarine pipelines, etc.

When sacrificial system is chosen, the weight of material required to provide the protection current for the protected lifetime of the structure is calculated from a knowledge of the current demand and also the specific electrochemical properties of the anode alloys.

The calculated weight of anode alloy cannot be installed all in one piece but must be distributed over the structure in the form of smaller anodes to ensure uniform distribution of current. In order to select the best size and shape of anode, the total current demand of the structure both at the beginning and end of its life must be considered. The anode must deliver adquate current to polarize the structure and build up cathodic chalks, but also must be capable of delivering the required mean current for the structure when 90% consumed.

Thus, on most offshore platforms a multiplicity of anodes are arranged on the various structural members of the platform. These anodes are generally attached to the platform before the platform is lowered to the ocean floor. Generally, the well conductor pipes are not provided with anodes as the conductors are lowered through the deck and driven into the ocean floor after the platform is in position. It has been found that by installing numerous anodes on the structureal elements of the platform in the vicinity of the well conductors that the conductors, which are welded at the top to the platform or are in electrical contact with the platform, are adequately protected against electrolytic corrosion in the sea water.

A major problem is encountered with a platform positioned over an offshore oil field with a calculated life of twenty years at the time the field was first put into production. In actuality, the field proved to have a life of forty years or more. Thus, it may be seen that the cathode protection system for the platform is probably inadequate to protect the steel platform from sea water corrosion for this longer period. Hence, it is generally necessary to add additional anodes to the underwater portion of the platform structure. On small simple platforms in shallow water, it is sufficient to lower an anode down through the water on a hoist cable and have a diver connect it to its underwater position on the platform. However, the large deepwater platforms containing a large number of well conductors comprise a maze of vertical and cross-bracing members but oftentimes there are not a sufficient number of members located next to a cluster of well conductors, to which anodes can be secured to provide adequate protection for the well conductors.

SUMMARY OF THE INVENTION

It is an object of the present invention to provide a method and apparatus for supplementing the substructure of an offshore platform within, or in the vicinity of, the well conductors of the platform so as to add large numbers of anodes distributed vertically within the platform adjacent the well conductors.

On the practice of this invention, a number of anodes, selected in number and composition, are attached to the outer surface of a number of short sections, say, 20 feet, of pipe. The pipe sections are transferred to a deck of an offshore steel platform where they are connected together in end-to-end relationship as they are lowered down through the platform to form an elongted tubular support for the anodes, said support being generally known hereinafter as an "anode carrier member" or "long anode apparatus". The anode carrier member, when positioned in the substructure of the platform and electrically connected thereto, provides an effective way to add an auxiliary anode system to a platform without the need to employ divers to carry out underwater welding to attach large numbers of heavy anodes to the platform substructure. Additionally, in large platforms used in deep water, say, 1,000 feet, the cross-bracing members of a platform substructure may be 50 to 100 feet apart. As the anodes positioned to protect a group of closely-spaced well conductors may have an effective protective range of only about 25 feet, the system of the present invention provides a method and apparatus for providing a rigidly-supported continuous and extended arrangement of anodes along a selected path within the platform that spans areas in which no cross-bracing members, or an insufficient number thereof, are located. The auxiliary anode system of the present invention is generally positioned within 25 feet of the platform members, including well conductors, to be protected and generally extends from just below the surface of the body of water to the vicinity of the ocean floor which includes extending into the ocean floor.

BRIEF DESCRIPTION OF THE DRAWING

FIG. 6 is a perspective view taken along the line 6—6 of FIG. 5;

FIG. 7 is a perspective view taken along the line 7—7 of FIG. 5;

FIG. 10 is a schematic plan view of an arrangement of two clusters of wells on an offshore platform.

DESCRIPTION OF A PREFERRED EMBODIMENT

Figure 1:
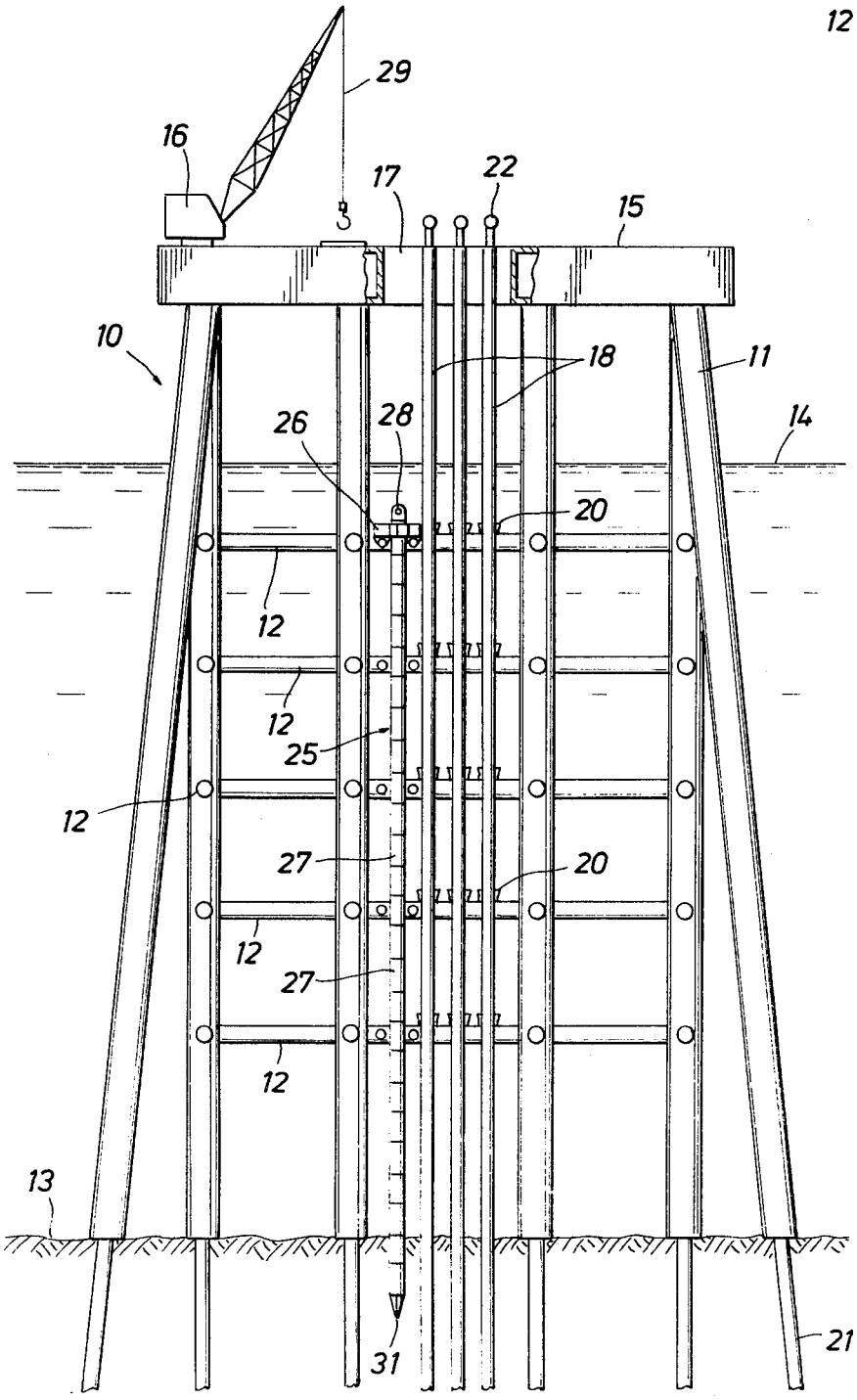
FIG. 1 is a diagrammatic view, taken in cross section, of an offshore platform showing an arrangement of well conductors in the platform together with the apparatus of the present invention.

Referring to FIG. 1 of the drawing, an offshore platform is generally represented by numeral 10 which may comprise a plurality of elongated tubular legs 11, which are interconnected by any arrangement of cross-bracing members 12. The legs 11 extend substantially vertically from the sea bed or ocean floor 13 to a suitable level, say 50 feet, above the mean water line 14 where they support one or more operating and/or storage decks 15. The deck may be provided with at least one hoist unit 16 for handling pipe and other equipment on the platform.

The upper and lower floors of the deck 15 are provided with one or more wellbays or opening 17 therethrough through which a well conductor 18 is passed at the start of well drilling operations. A well conductor 18 is generally heavy-walled pipe, say, 20 inches in diameter, which is made up of 30 or 40 foot sections of pipe which are welded or screw-threaded together, in a manner well known to the art, on the deck 15 of the platform 10 and then lowered through opening 17. A platform may have from 1 to 80 well conductors depending on the number of wells to be drilled.

A deep-water platform 10, say one located in 300 feet of water, may be equipped with a series of bellguides 20 which are secured, as by welding, to the cross-bracing members 12 of the platform 10 when it is fabricated on land. If desired, the bellguides 20 may be displaced laterally an increasing amount from top to bottom so that a centerline passing through the bellguides falls in a downwardly and outwardly directed curved line in the event that curved conductors are to be used in a manner well known to the art.

The platform 10 is generally secured to the ocean floor 13 by driving piles 21 down through the tubular legs 11 into the ocean floor where they may be cemented in place. During the drilling of a well through a well conductor 18, one or more strings of casing and one or moe tubing strings are run into the well and are hung from and/or supported by a wellhead 22 which closes the top of the well and conductor 18 during production operations.

In a typical well installation, a 20 inch diameter well conductor 18 is made up on the platform 10, section by section being connected together in end-to-end relationship, and lowered through the wellbay 17 and then down through the bell guides 20 to the ocean floor 13. Additional sections of pipe are secured to the top of the well conductor 18 as it is driven into the ocean floor 13, say to a depth of 250 feet, by the use of a pile driver in a manner well known to the art. Well drilling operations are carried out through the well conductor 18 down to, say, 2,000 feet. A string of casing, say $10\frac{3}{4}$ inches in diameter, is run into the hole, hung from the wellhead 22 and cemented in place. Well drilling operations are continued to, say, 10,000 feet and another string of casing is run into the well, hung from the wellhead 22 and cemented in place. This casing string may be 7 inches in diameter and may surround a $2\frac{1}{2}$ inch tubing string.

It is a general practice to protect offshore platforms against electrolytic corrosion either by equipping it with an impressed-current cathodic protection system or with sacrificial anodes, or by both. Even though such equipment is used, the environmental factors at a platform location may change over the years resulting in inadequate protection to well conductors on many of the platforms that have been in the water over ten years.

In view of the fact that the condition of the basic platform may be good and the oil and/or gas field may be produced for many more years, a method was developed for supplying to the platform additional protection against corrosion caused by sea water. While it has been known to supply a platform with additional anodes by affixing the anodes to the platform substructure or the cross-bracing members thereof, as through the use of a remotely-controlled underwater vehicle, it is after the case that there are not any platform cross-bracing members within the operative range, say, 25 feet, of that portion of the platform which most needs corrosion protection, namely, a cluster of well conductors.

One typical arrangement of wells on a platform deck 15 is shown in FIG. 10. In this case the platform is provided with two clusters 23 and 24 of wells wherein the wellheads, and the well conductors extending downwardly therefrom, are arranged in four rows of eight wells each, the centerlines of the wells being 5 feet apart in one direction and 7½ feet apart in the other. Since the vertical spacing between the platform cross-bracing members 12 (FIG. 1) may be in the order of from 70 to 90 feet in a large deepwater platform, it may be seen that parts of the well conductors would not receive any corrosion protection from anodes having a 25 foot effective range if the supplemental anodes being added to the platform were connected to the cross-bracing members 12.

Hence, the present method and apparatus were developed by which supplemental or auxiliary anodes could be fixedly secured to an elongated substantially rigid anode carrier member, which in turn could be hung on or secured to the cross-bracing members of a platform substructure in operative proximity to the platform well conductors to protect them from corrosion at least along the underwater length of the conductors.

Figure 2:
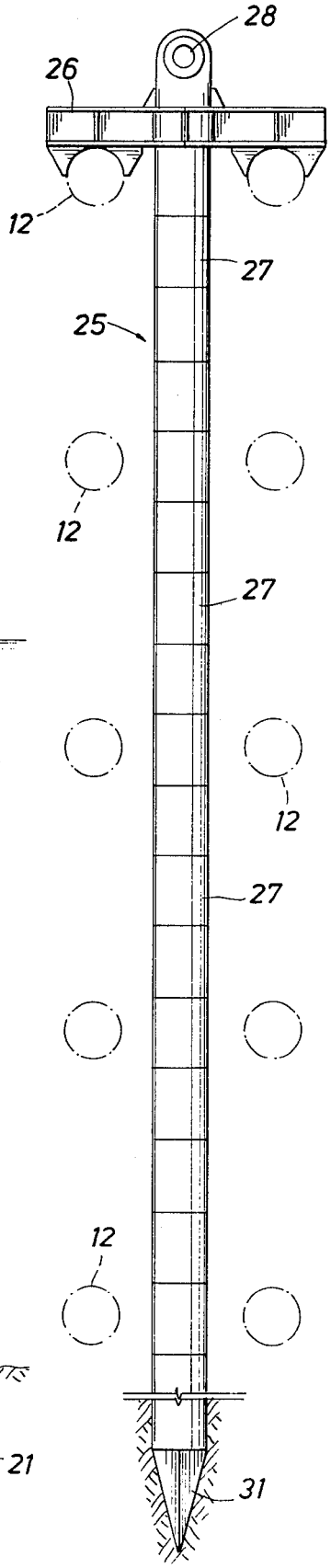
FIG. 2 is a diagrammatic longitudinal view of the anode carrying member of FIG. 1.
Figure 3:
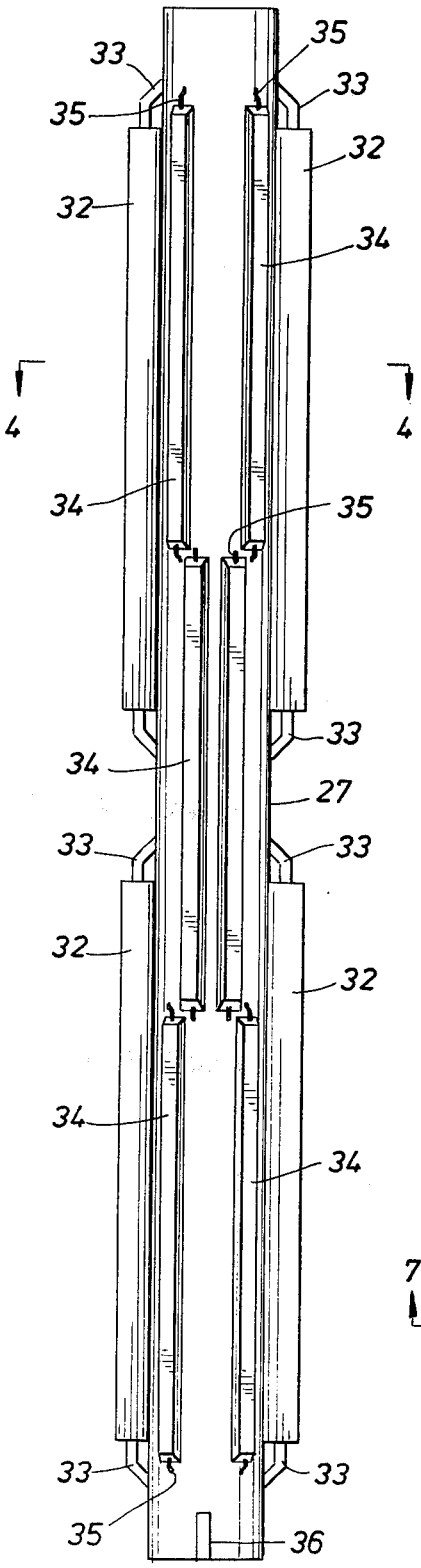
FIG. 3 is a longitudinal view of one arrangement of anodes carried on one section of the anode carrying member of FIG. 2.

The anode carrier member or apparatus, generally represented by numeral 25 in FIGS. 1 and 2 of the drawing is also spoken of as a "long anode apparatus" when anodes are mounted, as by welding, to the outer surface thereof, as shown in FIG. 3. The anode carrier 25, which may be up to 1,000 feet long, is necessarily made up or fabricated on the platform 10. The long anode carrier 25 is provided with means for connecting it to or hanging it from the platform by any suitable weight-supporting means. In the embodiment illustrated, it is desired to hang the long anode carrier 25 from an upper cross-bracing platform member and this is accomplished by providing a hanger 26. The hanger 26 is secured, as by welding, bolting, etc. near the upper end of the anode carrier 25, as will be discussed in greater detail with regard to FIGS. 8 and 9.

The anode carrier 25 is made up of a plurality of sections 27 of the pipe, say, 18 inches in diameter with a ½ inch wall thickness, for example. The sections 27 of the anode carrier 25 may range from about 15 feet to 35 feet or more in length depending upon the size most convenient to handle on the platform 10, or on which anodes of a predetermined length can be mounted. If desired, lowering means such as a pad-eye 28 may be welded to the uppermost section 27 of the anode carrier 25. A lowering cable 29 may be secured to the pad-eye 28 for suspending the anode carrier apparatus 25 below the deck 15 of the platform 10 while the hanger 26 is connected to the anode carrier 25. Subsequently the cable 29 would be used to lower the hanger 26 to its seated position (FIG. 1) on a pair of cross-bracing members, as will be described hereinbelow with regard to FIGS. 8 and 9.

As shown in FIG. 1, the upper end of the anode carrier 25 is in the vicinity of the surface 14 of the ocean. For ease in hanging the anode carrier 25 from the platform 10, the top of the anode carrier 25 may be above the water surface 14. However, in order to reduce the wave loading on the upper end of the anode carrier 25, and thus on the platform 10, it is preferred that the upper end of the anode carrier 25 be located from 10 to 50 feet below the water surface 14 depending upon the wave forces to be encountered at the platform location.

Additionally, in order to offset wave loading stresses on the upper end of the anode carrier 25, the upper sections thereof exposed to wave action, say, down to 80 feet below the water surface 14, are made of a thicker-walled pipe, say, one inch in thickness. In a like manner, if the lower end of the anode carrier 25 is positioned from 10 to 150 feet in the ocean floor, (FIGS. 1 and 2) both the lower sections 27 of the anode carrier 25 in the ocean floor and those sections extending 20 to 100 feet above the ocean floor 13 are preferably made of thicker-walled pipe (say, 1 inch thickness) than the sections 27 thereabove. Thus, with regard to the wall thickness of the anode carrier 25 from top to bottom, the anode carrier may be said to be "tapered". On extremely long tapered anode carriers 25, the wall thickness is, for example, 1 inch in the top portion, ¾ of an inch in the next lower portion, ½ inch in the central portion, ¾ of an inch in the next lower portion and 1 inch in the lowermost portion that extends down into the ocean floor. It is preferred that long heavy anode carriers 25 extend into the ocean floor 13 to help support the anode carrier which may weigh many tons, and limits any lateral movement of the lower end. Supporting a portion of the weight of the anode carrier in the ocean floor, reduces the weight that the hanger 26 and the platform 10 must support. Since all tall offshore platforms bend to some degree in a storm, the use of thicker-walled pipe in the lower portion of the anode carrier 25 extending into the ocean floor, allows the anode carrier to withstand better the bending stresses to which it is subjected.

As shown in FIGS. 1 and 2, the lower end of the anode carrier 25 may be provided with a suitable pointed section 31, which may be in the form of a cone, to aid the penetration of the anode carrier into the ocean floor 13.

Figure 4:
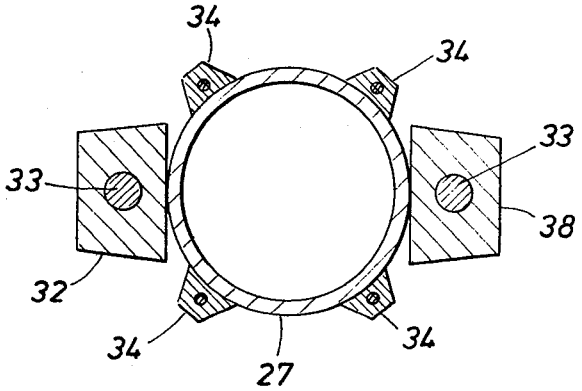
FIG. 4 is a cross-sectional view taken along the lines 4—4 of FIG. 3.

One form of a section 27 of an anode carrier 25 (FIG. 2) is shown in FIGS. 3 and 4 as comprising a plurality of aluminum alloy anodes 32 having steel core ends 33 extending out the ends thereof which serve as connector elements which may be welded to the outer surface of the steel pipe or section 27 of anode carrier 25. Additionally, the section 27 is preferably provided with a group of magnesium anodes 34 (six being shown in FIG. 3) which have their steel core elements 35 welded to the outer surface of the steel pipe anode section 27. The number and arrangement of the anodes 32 and 34 on each section 27 depends upon the current needs at each location to supply the needed protection against corrosion. If desired, each section 27 may be provided with a pair of pad-eyes 36 on opposite sides of the section 27 so as to support the lowermost sections 27 of the anode carrier 25 as another section 27 is welded on the top thereof during construction.

In FIG. 1 the anode carrier 25 is shown as having its hanger 26 seated on the uppermost cross-bracing member 12 of the platform 10. As the anode carrier 25 is positioned and extends downwardly past the lower cross-bracing members 12, it may be provided with suitable means for positioning the anode carrier 25 against any substantial lateral movement relative to the cross-bracing members 12 of the platform 10. At each level of cross-bracing members 12 in the platform substructure, the cross-bracing may be arranged in a manner shown in the plan view in FIG. 5. In this platform, parallel cross-bracing members 12 are connected together by cross-bracing members **12*a* to form a rectangular opening 37 down through which the anode carrier 25** is run and positioned.

Figure 5:
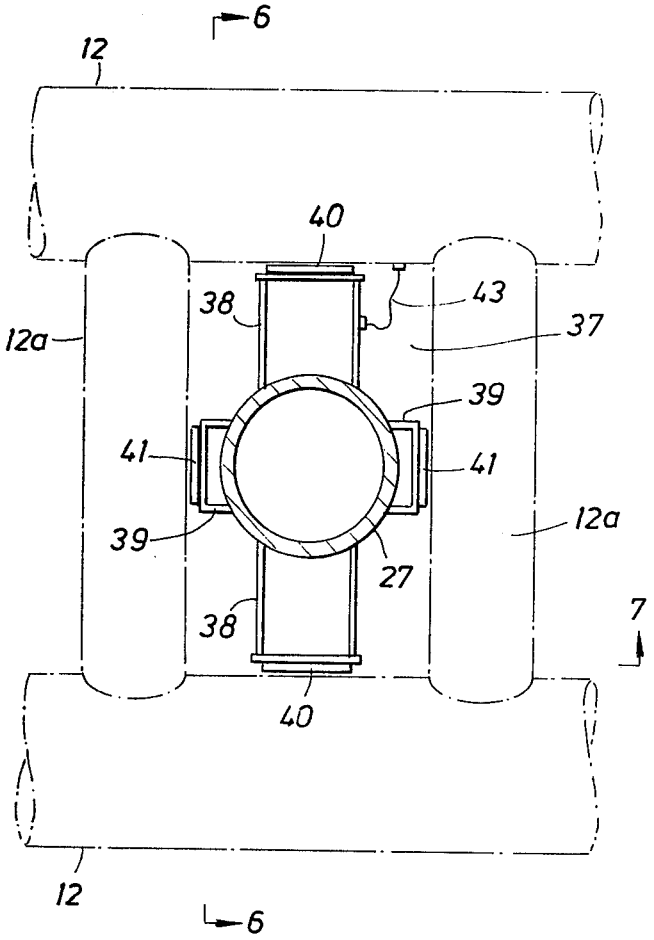
FIG. 5 is a plan view, taken in partial cross section, of one form of lateral spacing elements mounted on the outer surface of the anode carrying member which is illustrated as being positioned between cross-bracing members (taken in plain view) at one level with the platform.

In order to limit lateral movement of the anode carrier 25 within the vertically-spaced openings 37 at each level, suitable means such as bumpers, spacer arms or lateral supports 38 and 39 are employed, as shown in FIGS. 5, 6 and 7. The arms 38 and 39 are of a size to pass through the openings 37 until the anode carrier hanger 26 is landed in its seated position, as shown in FIGS. 1 and 2. At this time the lateral supports or bumper elements 38 and 39 are positioned adjacent the cross-bracing members 12 and **12*a* at each level. Due to the size of the opening 37, the lateral supports 38 are longer than the lateral supports 39 running in the opposite direction. The outwardly extending faces of the lateral supports 38 and 39 are preferably provided with bumper elements of a resilient material, such, for example, as urethane pads 40 and 41 bonded to the ends of supports 38 and 39**, respectively.

It may be seen in FIGS. 6 and 7 that the anodes 32 or 34 must be located above or below the lateral supports 38 and 39. At each level, the section 27 of the anode carrier 25 is preferably electrically connected to the adjacent cross-bracing member 12 or **12*a*, or a steel element (as a bell guide) connected thereto, of the platform substructure by means of a flexible electrically-conducting cable 43 which may be installed in any manner well known to the art, as by a diver or a remotely-controlled underwater vehicle. The metal hanger 26 when seated on its receiving cross-bracing members may also serve as an electrical connection between the anode carrier 25 and the platform 10, although a cable similar to that shown at 43** may also be used between the platform and the hanger.

Figure 8:
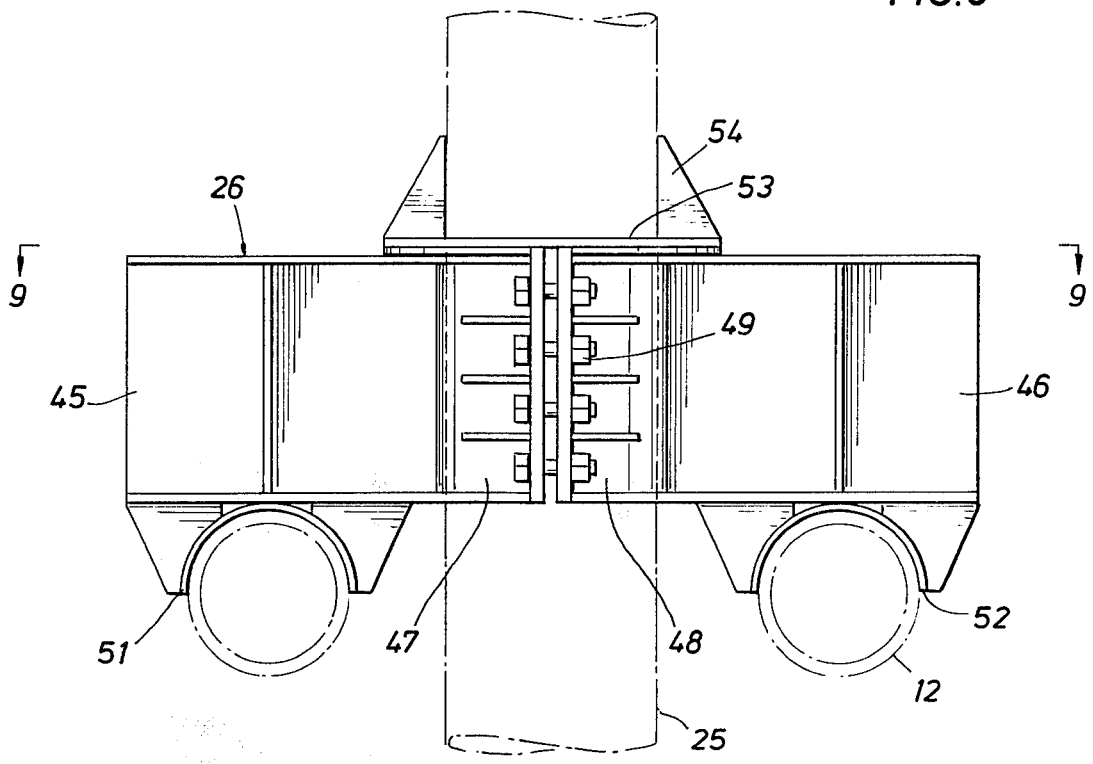
FIG. 8 is a perspective view of a clamp and support apparatus secured near the upper end of the anode-carrying member while being positioned on cross-bracing members of the platform.
Figure 9:
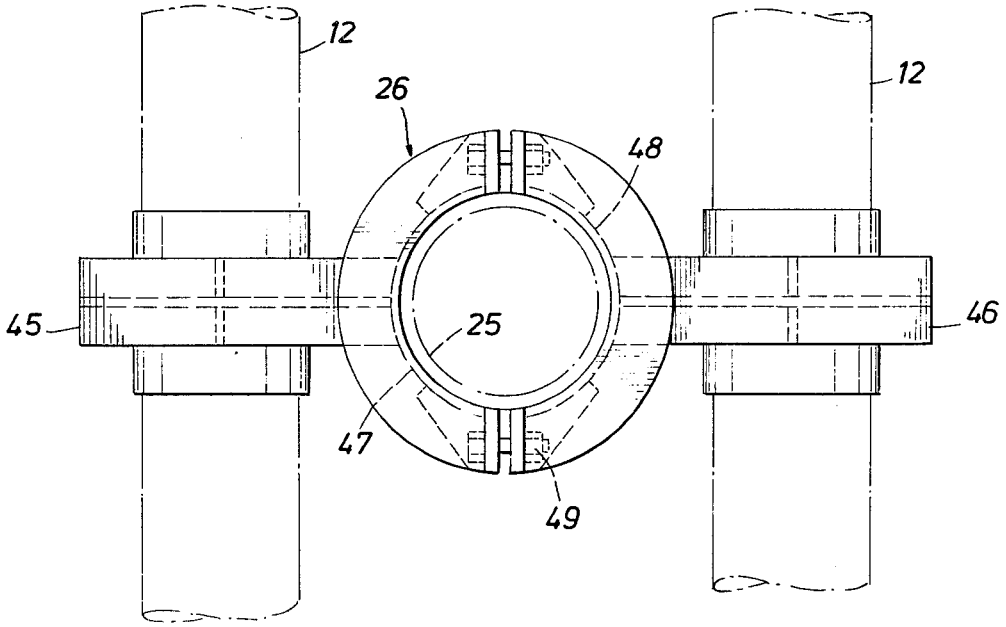
FIG. 9 is a plan view taken along the line 9—9 of FIG. 8.

Referring to FIGS. 8 and 9 of the drawing, one form of a hanger 26 is illustrated as comprising lateral support beams 45 and 46 having split pipe clamp segments 47 and 48 welded to adjacent ends thereof which in turn are adapted to be secured together, preferably by bolts 49. The inner or operative surfaces of the clamp segments 47 and 48 is of a radius adapted to mate with the outer surface of the anode carrier 25.

Welded to the underside of the support I-beams 45 and 46 are a pair of concave saddle elements 51 and 52, having axes that are horizontal, and are of a size and shape so as to mate with the cross-bracing members 12 of the platform 10.

The anode carrier 25 is provided with suitable stop means or a seating shoulder adapted to seat on or engage the top of the hanger 26 as shown in FIG. 8. The stop means may take the form of a ring element or plate 53, preferably reinforced by gussets 54, both of which are welded to the outer surface of the anode carrier 25 at a preselected distance from the top thereof. Alternatively, the hanger 26 may be of the non-removable type and hence may be welded directly to the anode carrier.

The present invention provides a method of adding anodes 32 and 34 (FIG. 3) to a platform 10 (FIG. 1) positioned at an offshore location in order to protect the platform substructure and the well conductors therein from corrosion. The sections 27 of the anode carrier 25 are manufactured on shore by welding anodes 32 and 34 thereto in a predetermined design. The sections 27 are then transported by barge to the platform 10 where they are hoisted onto the deck where they are to be welded together.

At a preselected opening in the deck of the platform, and within operative anode range of at least some of the well conductors 18, the pointed lower section 31 of the anode carrier 27 is lowered into the opening 37 (FIG. 5) and suspended there as an anode section 27 is welded to the top thereof. Successive anode sections are welded to each other in end-to-end arrangement. The operation is carried out in a stepwise manner, first making a weld, lowering the anode carrier 25 about 20 feet and then adding and welding a new anode section 27 to the top thereof. The procedure is continued until the many anode sections 27 that make up the predetermined length of the anode carrier 25 have been connected together. At this point the anode carrier 25 extends downwardly through a series of vertically-aligned rectangular openings 37 (FIG. 5) in the platform substructure. During the assembling of the anode carrier 25, the lateral supports 38 and 39 are added to the anode carrier. The axial spacing of the lateral supports 38 and 39 on the anode carrier 25 is equal to the vertical spacing between the cross-bracing members 12 of the platform 10. Thus, when the anode carrier 25 is in its final position with its upper end supported on the platform 10 by anode carrier hanger 26 and/or its lower end penetrating the ocean floor 13 to either partially or entirely support the weight of the anode carrier 25, then the lateral supports 38 and 39 are opposite the cross-bracing members 12, at least at some of the cross-bracing levels within the platform substructure. At this time the hanger may be connected to the anode carrier 25 near the upper end thereof. If the hanger is of the split type described hereinabove, and its connection to the anode carrier 25 is made at an underwater location, divers or remotely-controlled underwater vehicles, well known to the art, may be used for this operation.

With the anode carrier 25 positioned within the platform, it is electrically connected, as by cables, to the platform at a plurality of positions along the length of anode carrier.

If the lowermost portion of the anode carrier 25 is lowered or driven (as by weights or a pile driver) into the ocean floor a substantial distance (say, 50 to 200 feet) or to a distance so that the entire weight of the anode carrier 25 is supported by frictional contact with the ocean floor, then some of the lower anode carrier sections 27 below the mud line of the ocean floor may be of normal large-diameter pipe (say, 18 inches) without any anodes 32 and/or 34 being welded to the outer surface thereof. Above the mud line the anode sections 27 would have the necessary compliment of anodes, as needed.

The depth to which the lower end of the anode carrier 25 can be inserted or driven into the ocean floor 13, can be ascertained or calculated in many areas by taking core samples of the near surface unconsolidated formations or from pile driving tests conducted in the area. Where the ground around an ocean-floor-supported anode carrier washes away or becomes compacted to a greater degree than the ground around the pile-anchored legs of a platform, then the hanger 26 takes over an increasing load of the weight of the anode carrier.

We claim as our invention:

1. A method of providing anodes for a platform that is in position at an offshore location, said platform being formed of a plurality of substantially vertical legs, lateral cross-bracing members between the legs in parallel-spaced relationship to each other at a plurality of vertically-spaced levels within the platform, and at least one deck supported by said legs above the water level, said platform being equipped with a plurality tubular elongated well conductors extending through the platform and the water beneath it and into the ocean floor below the mudline, said platform and well conductors being of a corrodible metal, said method comprising:

securing and electrically connecting at least one anode to an elongated tubular anode carrier section, assembling a plurality of said anode carrier sections at the platform at its offshore location, connecting, at a point above the water line, a plurality of said anode carrier sections in end-to-end relationship to form an elongated tubular long anode apparatus, positioning said long anode apparatus vertically in the platform below the deck thereof in the vicinity of, but out of contact with, the well conductors, lowering said long anode apparatus, as it is being formed, down through the water and between the spaced lateral bracing members of the platform at a point selected in the vicinity of the well conductors, continuing to connect additional anode carrier sections to the top of the long anode apparatus to form said apparatus having a length at least sufficient to extend over at least a major portion of the water depth in which the platform is located, supporting the long anode apparatus in weight-supporting engagement adjacent to the well conductors, and electrically connecting said long anode apparatus at a plurality of positions along the length thereof to the platform.

2. The method of claim 1 wherein the long anode apparatus is supported in weight-supporting engagement to the platform by hanging it near its upper end from at least one lateral cross-bracing member of said platform.

3. The method of claim 2 wherein the long anode apparatus is hung from at least a pair of spaced-apart lateral cross-bracing members of said platform.

4. The method of claim 3 wherein the hanging long anode apparatus is arranged to suspend in the space between a plurality of similar spaced-apart lateral cross-bracing members at lower vertically-displaced levels within said platform and includes the step of limiting the lateral movement of said long anode apparatus between spaced-apart lateral cross-bracing members of said platform.

5. The method of claim 4 including the step of limiting the lateral movement of the lower end of the long anode apparatus by extending the lower end thereof into the ocean floor.

6. The method of claim 1 including the step of forming the long anode apparatus in a length sufficient to extend vertically through the platform adjacent to at least some of the well conductors, with the upper end of the long anode apparatus being located in the vicinity of the water line and the lower end being in the vicinity of the mud line.

7. The method of claim 6 including the step of supporting at least a portion of the weight of the long anode apparatus by the ocean floor by extending the lower end of said long anode apparatus into the ocean floor, in frictional weight-supporting engagement therewith, for a distance sufficient to reduce the weight of the long anode apparatus hung from the platform.

8. The method of claim 6 including the step of reducing the lateral wave loading on the long anode apparatus and on the platform by positioning the upper end of the long anode apparatus at least about 10 feet below the water line.

9. The method of claim 4 wherein the lateral movement of the long anode apparatus, between spaced-apart lateral cross-bracing members of said platform, is limited by fixedly securing to the outer surface of said long anode apparatus, at spaced intervals along the length thereof, spacer means forming bumper elements, with the axial spacing of said bumper elements along said long anode apparatus corresponding to the vertical spacing between the cross-bracing members of said platform so that the bumper elements will engage said cross-bracing members at a plurality of levels above the ocean floor.

10. The method of claim 3 wherein the step of connecting the long anode apparatus in weight-supporting engagement with the platform includes the steps of securing hanger means near the upper end of the long anode apparatus prior to lowering the hanger means into seating arrangement on a pair of spaced-apart lateral cross-bracing members located at least 10 feet below the water line.

11. The method of claim 10 including the steps of temporarily hanging the long anode apparatus by a lowering cable just above its final underwater position within the platform, making an underwater connection to secure the hanger means to the long anode apparatus, lowering the hanger means into its seating position on an underwater pair of cross-bracing members, and disconnecting and withdrawing the temporary lowering cable to the surface.

12. The method of claim 1 including the step of providing a plurality of anodes on a majority of each anode carrier section.

13. The method of claim 1 including the step of providing anodes with the major portion of the total anode weight being of a predominantly aluminum composition while the remainder are of a predominantly magnesium composition.

14. For use with a platform that is in position at an offshore location, said platform being formed of a plurality of substantially vertical legs, lateral cross-bracing members between the legs in parallel-spaced relationship to each other at a plurality of vertically-spaced levels within the platform, and at least one deck supported by said legs above the water level, said platform being equipped with a plurality tubular elongated well conductors extending through the platform and the water beneath it and into the ocean floor below the mudline, said platform and well conductors being of a corrodible metal, a corrosion-inhibiting long anode apparatus adapted to be installed on the offshore platform, said apparatus comprising:

an elongated tubular anode carrier apparatus made up of a plurality of shorter anode carrier sections, at least one anode fixedly secured and electrically connected to each anode carrier section, said anode carrier sections being secured together in end-to-end relationship while being temporarily suspended vertically in said platform at a point selected in the vicinity of the well conductors, hanger means fixedly secured to said anode carrier apparatus near the upper end thereof and being adapted to seat on lateral cross-bracing members of said platform at least at an underwater location for suspending at least a portion of the weight of the anode carrier vertically within said platform in the vicinity of the well conductors thereof, and a plurality of electrical connector means carried at axially-spaced locations on said anode carrier apparatus for forming multiple electrical connections with the platform.

15. The apparatus of claim 14 including a stabbing tip affixed to the lower end of the anode carrier apparatus for facilitating entry into the ocean floor.

16. The apparatus of claim 14 wherein the hanger means comprises at least two sections adapted to be bolted around the anode carrier apparatus, the lower surface of said hanger means being formed with two downwardly-directed concave saddle portions on opposite sides of the anode carrier apparatus and spaced one from the other a distance equal to the spacing between a pair of lateral cross-bracing members of the platform on which they seat.

17. The apparatus of claim 14 wherein the length of the anode carrier apparatus is selected such that it is weight-supporting engagement with the ocean floor when the hanger means is in its seated position in the platform.

18. The apparatus of claim 14 including a plurality of bumper elements secured at spaced intervals along the anode carrier apparatus, the spacing of the bumper elements along said anode carrier apparatus corresponding to the vertical spacing between the cross-bracing members of the platform to be engaged by said bumper elements.

19. The method of claim 1 in which the long anode apparatus is supported in the platform by inserting the lower end of the long anode apparatus into the ocean floor a distance to support the entire weight thereof at the time of installation.

* * * * *